United States Patent [19]

Stevenson et al.

[11] Patent Number: 4,714,375

[45] **Date of Patent: * Dec. 22, 1987**

[54] SEAPLANE AND DOCK LIFT

[75] Inventors: Ernest W. Stevenson, Danville; Randall E. Nahas, Alamo, both of Calif.

[73] Assignee: Levitator, Inc., Glenbrook, Nev.

[ * ] Notice: The portion of the term of this patent subsequent to Nov. 13, 2001 has been disclaimed.

[21] Appl. No.: 877,013

[22] Filed: Jun. 20, 1986

Related U.S. Application Data

[63] Continuation-in-part of Ser. No. 671,007, Nov. 13, 1984, abandoned.

[51] Int. Cl.[4] ..... B63C 3/06

[52] U.S. Cl. ..... 405/3; 405/1; 114/44; 114/262

[58] Field of Search ..... 405/1-7, 405/219, 221; 114/44-49, 261, 262, 361; 414/680

[56] References Cited

U.S. PATENT DOCUMENTS

| | | | |
|---|---|---|---|
| 1,752,894 | 4/1930 | Degen | 114/45 |
| 1,937,973 | 12/1933 | Mayo | 114/262 |
| 2,536,475 | 1/1951 | Thomas | 114/45 |
| 2,536,908 | 1/1951 | Chadwick | 114/44 X |
| 2,594,773 | 4/1952 | Harris | 114/45 X |
| 2,761,409 | 9/1956 | Harris | 114/262 |
| 2,976,694 | 3/1961 | Standford | 405/1 |
| 3,177,668 | 4/1965 | Schneider et al. | 405/3 |
| 3,265,024 | 8/1966 | Kramlich | 114/45 |
| 3,276,211 | 10/1966 | Drake | 405/3 |
| 3,362,172 | 1/1968 | Rutter | 405/3 |
| 3,559,606 | 2/1971 | Gregory | 405/3 X |
| 3,603,276 | 9/1971 | De Lisle | 114/45 |
| 3,753,355 | 8/1973 | Knoch | 405/3 |
| 3,777,691 | 12/1973 | Beale | 114/48 |
| 3,976,022 | 8/1976 | Lapeyre | 114/45 |
| 4,019,212 | 4/1977 | Downer | 114/361 |
| 4,027,492 | 6/1977 | Carpenter | 405/3 |
| 4,084,529 | 4/1978 | Katernberg | 405/3 |
| 4,329,082 | 5/1982 | Gillis | 114/48 |
| 4,401,335 | 8/1983 | Godgersen | 294/84 |
| 4,432,664 | 2/1984 | Baldyga | 405/3 |
| 4,482,268 | 11/1984 | Stevenson et al. | 405/1 |

FOREIGN PATENT DOCUMENTS

| | | | |
|---|---|---|---|
| 1531698 | 4/1970 | Fed. Rep. of Germany | 114/48 |
| 2042850 | 3/1971 | Fed. Rep. of Germany | 114/48 |
| 918178 | 4/1982 | U.S.S.R. | 114/45 |

*Primary Examiner*—Nancy J. Stodola
*Attorney, Agent, or Firm*—James R. Cypher

[57] ABSTRACT

A watercraft lift supported on one or a pair of stanchions that include a sleeve assembly mounted for slidable movement on the stanchions. A platform is mounted on forks carried by a cross arm inserted into the sleeve assemblies which protrude out from the stanchions. Upright members mounted on the platform carry fender members.

In a modified form of the invention a single stanchion with a similar sleeve assembly, a cross arm and twin forks, lifts a floating dock.

In a further modified form, a single stanchion with a similar sleeve assembly, a cross arm and twin forks, lifts a non-floating dock.

In still another modified form a single stanchion with a sleeve assembly cross arm and twin forks carries a spaced frame for receiving a seaplane.

14 Claims, 22 Drawing Figures

SEAPLANE AND DOCK LIFT

PRIOR APPLICATION

This application is a continuation-in-part of our copending application entitled SEAPLANE AND DOCK LIFT filed Nov. 13, 1984, which received Ser. No. 06/671,007, now abandoned.

BACKGROUND OF THE INVENTION

Lightweight aircraft which have been outfitted with twin pontoons for operation from lakes and rivers must be removed from the water during heavy winds or moderate wave action to prevent overturning or damage to the craft. Unlike most boats which are designed for relatively rough water, the pontoons for aircraft are designed as light and stream lined as possible so that the aircraft can fly as efficently as possible. This means that the pontoons are just barely able to keep a maximum loaded plane afloat. It is not uncommon for passengers loading and unloading to get their feet wet, even standing on a pontoon.

Because the pontoons are made from lightweight thin materials, dragging a seaplane up on a beach to get it out of the water often damages the very expensive pontoons.

At present, there are no lifts which are suitable for lifting a light seaplane from the water, which are supported by stanchions driven into the lake or river bed. Present lifts which are designed for boats do not have the structure to support the pontoons yet enable the propeller to be free of obstructions.

In addition to seaplanes, a wide variety of watercraft require lift mechanisms that can be positioned below the water line and then lift the craft above the water level. Such craft include twin hull boats, and one man motorized craft known as "Ski-doos."

Boat lifts have been found to be inadequate to meet the needs of seaplane owners who wish to quickly and easily lift these planes out of the water and launch them with the same ease and speed. The need for lifting ease and speed requirements may range from simple convenience to necessity in coping with difficult conditions induced by high waves, fast current or high winds.

Further, the present boat lifts are capable of raising a boat only a few feet while many lakes and dams may periodically rise and fall five, ten or even fifteen or more feet due to hydroelectric power generation and re-generation by refilling the lake during off peak power generation hours. Rivers and flood control dams or sea coast waterways subject to tides can rise and fall several feet and render all but the largest lifts useless at low water conditions.

The increase in the number of seaplanes, twin hull boats and ski-doos and the need to maintain clear channels has made it impossible in many locations to install the prior art devices which are set on the bottom of the lake or river and remain submerged in the water when not lifting a boat. Such apparatus is a hazard to other boats and cannot be used where a clear channel is required.

Finally, probably none of the above prior patented lifts can operate in water as shallow as the lift of the present invention.

SUMMARY

The present lift provides a lift which can lift and launch a seaplane or twin hull boat with unprecedented speed and convenience. Instead of a bothersome and sometimes dangerous and tedious chore, docking and launching is so rapidly and easily accomplished that even the most ardent and skilled seaplane owner will find that he uses his plane much more frequently.

Since the lift of the present invention can raise a plane fifteen (15) or more feet, expensive floating docks are no longer required with dry docks which operate with lifting pontoons. Moreover, the present lift can be used where the water level is subject to very wide variations.

The present lift requires but one or two stanchions driven into the bottom of the lake or river together with a simple lateral support. The entire lifting apparatus can be raised high above the water leaving a clear channel except for very high cabin boats or sail boats.

In a modified form of the invention, the lift is constructed with a single stanchion, a sleeve member, a cross member and fork member for lifting a floating dock above the water.

In still another form, the dock is non-floating and the dock can be lowered below the water and the hull of the boat. The dock and boat can then be lifted above the water.

A further modified form discloses a single stanchion seaplane lift.

Finally, the present lift can lift seaplanes in very shallow or deep water with equal ease because of the minimum amount of apparatus between the deck and the lowermost portion of the lift. This can extend the time of launchings and liftings beyond the "high-tide" only launchings.

DESCRIPTION OF THE PREFERRED EMBODIMENTS OF THE INVENTION

Figures 1, 5:
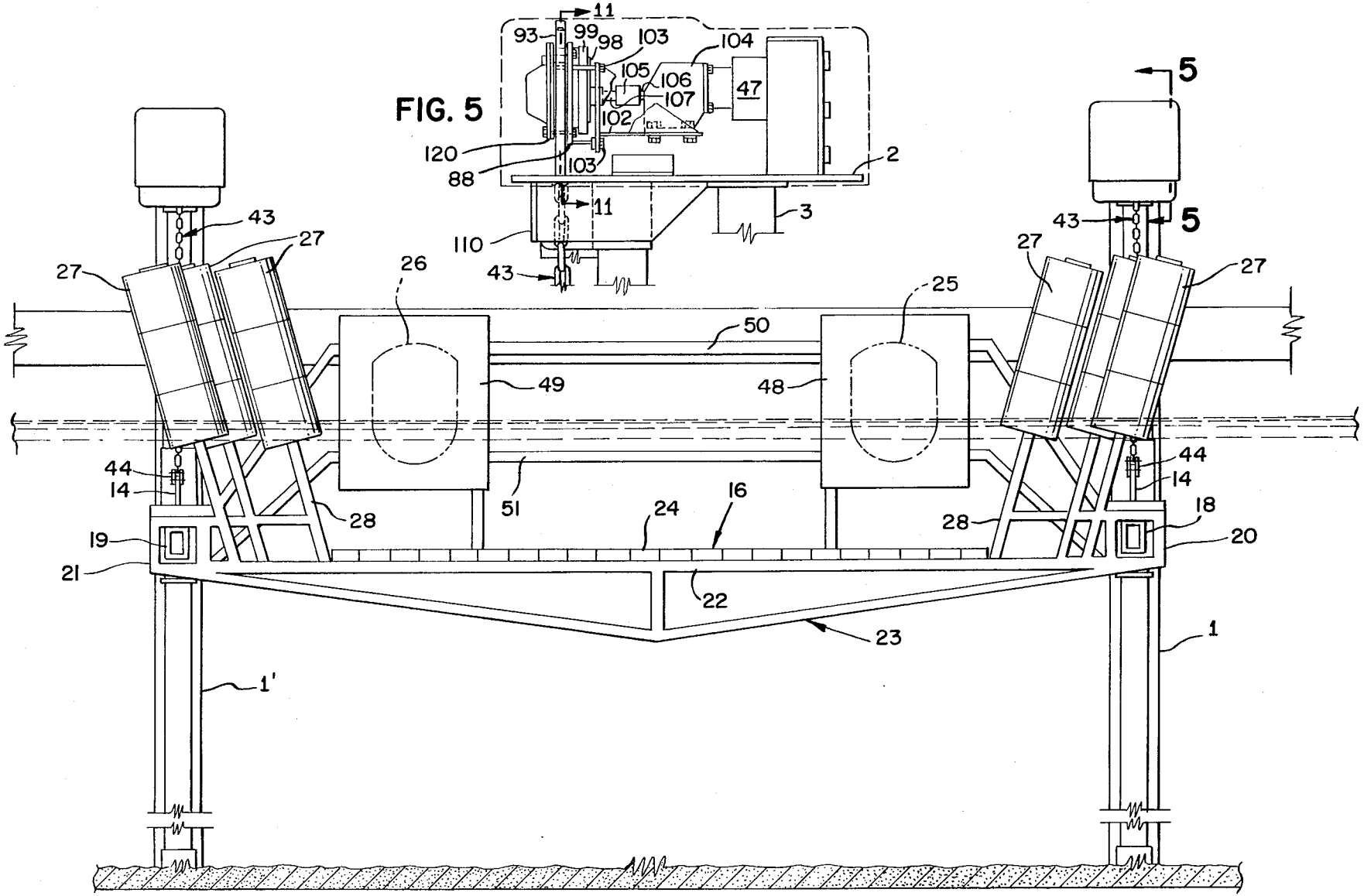
FIG. 1 is a front elevation view of the lift of the present invention. A portion of the pontoons of a seaplane floating above the platform is shown in phantom line. The dashed lines indicate the water surface. The lift is in place for raising the seaplane above the water.
FIG. 5 is a side elevation view of a portion of the lift on an enlarged scale with portion of the cover removed to show the chain lift and motor.

Referring to FIGS. 1-6 of the drawings, the seaplane platform is supported on dual load bearing stanchion members 1 and 1' which may be a ⅜" wall 5" by 5" square tube. A base plate 2 of considerable rigidity, such as a ½ steel plate is seated on the top of the stanchion and suitably braced. A bracket member 3 is connected to the base plate laterally disposed from the stanchion member and is adapted for connection to a stabilizing member 4. The size and configuration of the bracket will depend upon whether the stanchion is to be stabilized by an existing pier 5 or by another member 4 driven into the lake or river bottom. The stablizing bracket must also be engineered depending upon the stability of the stanchion to resist lateral forces. In some instances the stanchions will be driven into the lake or stream bottom while in other installations they may be anchored in a foundation.

A sleeve assembly 6 is slidably mounted on each stanchion member for travel thereon. The sleeve assembly here consists of an inner sleeve 7 which surrounds each stanchion and is constructed from ⅜" wall tube 6"×6"×4' and distributes the moment load on the stanchion. Lower braces 8 and side braces 10 and 11 and lifting flange 14 are welded to the inner sleeve and to fork members 18 and 19.

A pair of fork members 18 and 19 are connected to the lower braces 8 and protrude from each of the stanchion members. The forks may be ⅜"×4"×4" tube×6'6" and are preferably connected to fork sleeves 20 and 21 which are mounted on platform 16.

Platform 16 consists of cross beams 22 connected to fork sleeves 20 and 21 and supported by truss members 23. Planking members 24 are connected to beams 22 and support the pontoons 25 and 26 of the seaplane. Lateral guide docking fenders 27 are slidably mounted on upstanding telescoping members 28 which preferably are inclined outwardly from the platform. Further, the upstanding members and fenders adjacent the outer edge of the platform are located further outwardly than the fenders located adjacent the stanchions so that the seaplane will be guided toward the center of the platform. As can be seen, the fender members 27 extend the telescoping upstanding members 28 as the platform is lowered into the water so that they will always be at the water level to guide the pontoons of the seaplane.

A lifting member 43 is connected to the sleeve assembly 6 and may be a cable or preferably a chain. The chain may be attached to a coupling 44 which is connected to a pin 45 inserted through an opening in lifting flange 14.

The chain is operatively connected to a mechanical multiplying means 46 which preferably is a chain fall. No special chain fall is required and the chain fall here shown is a 3 ton rated chain fall manufactured by Ratcliff in Redwood City, Calif.

The chain fall may be hand operated, but preferably a power means 47 is connected to the chain fall. The power means may be an internal combustion engine but where electrical power is available, a ¾ horsepower electrical motor may be used. The motor can drive the chain fall so that the lift travel is approximately 4 feet per minute. In order to keep the platform level while lifting or lowering the platform, a standard interlock device is connected to each of the electric motors so that they will switch on and off simultaneously and will turn at the same r.p.m.

To assist in docking the seaplane, a pair of docking targets 48 and 49 are connected to cross arms 50 and 51 on the front side of the platform.

Figure 6:
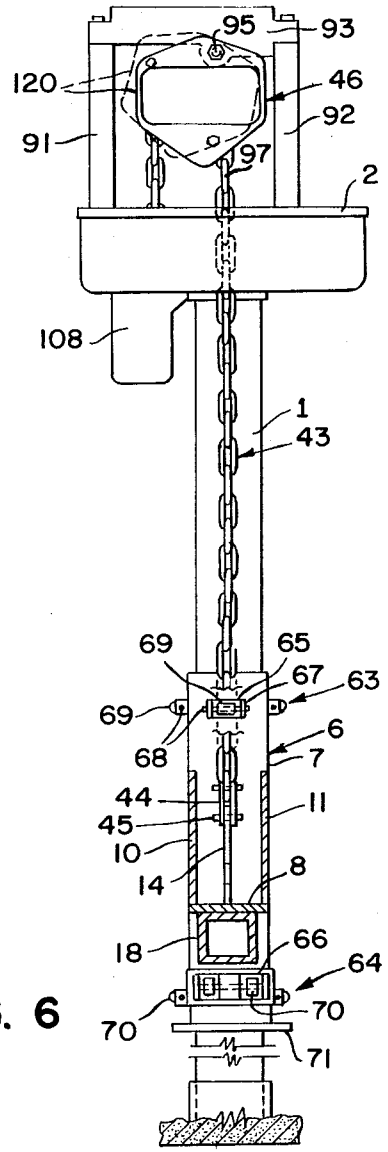
FIG. 6 is an enlarged front cross sectional view taken along line 6—6 of FIG. 2 of one of the stanchion members and the chain hoist.
Figure 2:
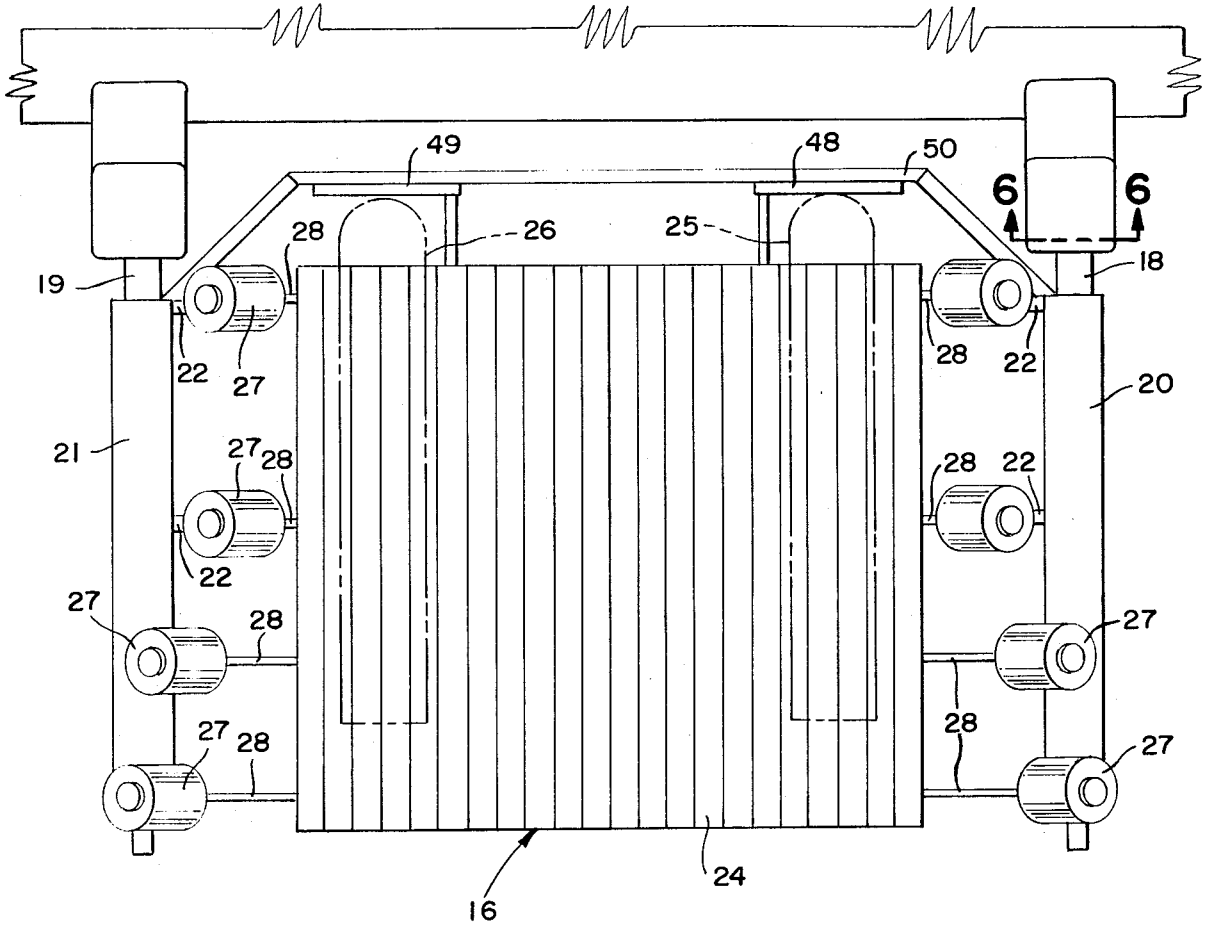
FIG. 2 is a top plan view of the lift shown in FIG. 1 with portions of the same seaplane pontoons in phantom line.
Figure 3:
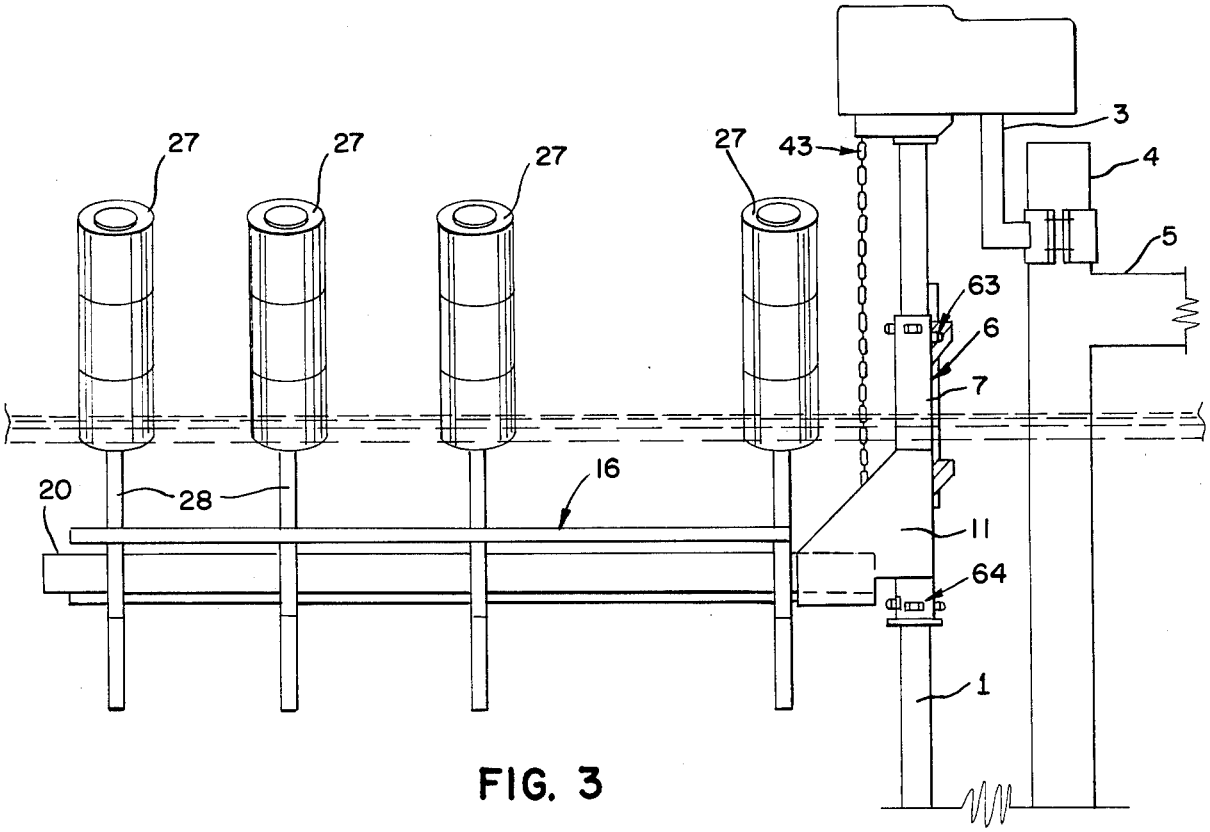
FIG. 3 is a side elevation view of the platform in FIG. 1 below the water.
Figure 4:
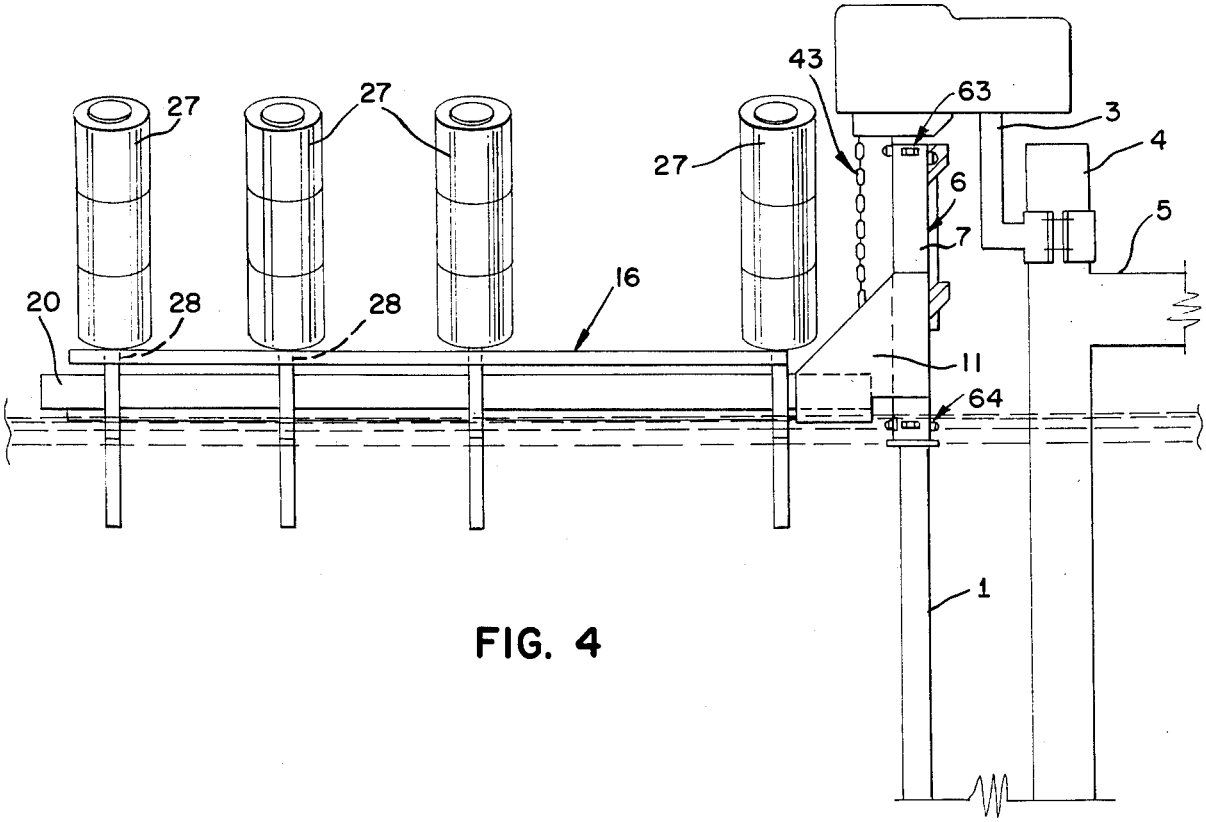
FIG. 4 is a side elevation view of the lift identical to FIG. 3 with the platform raised above the water line.
Figure 7:
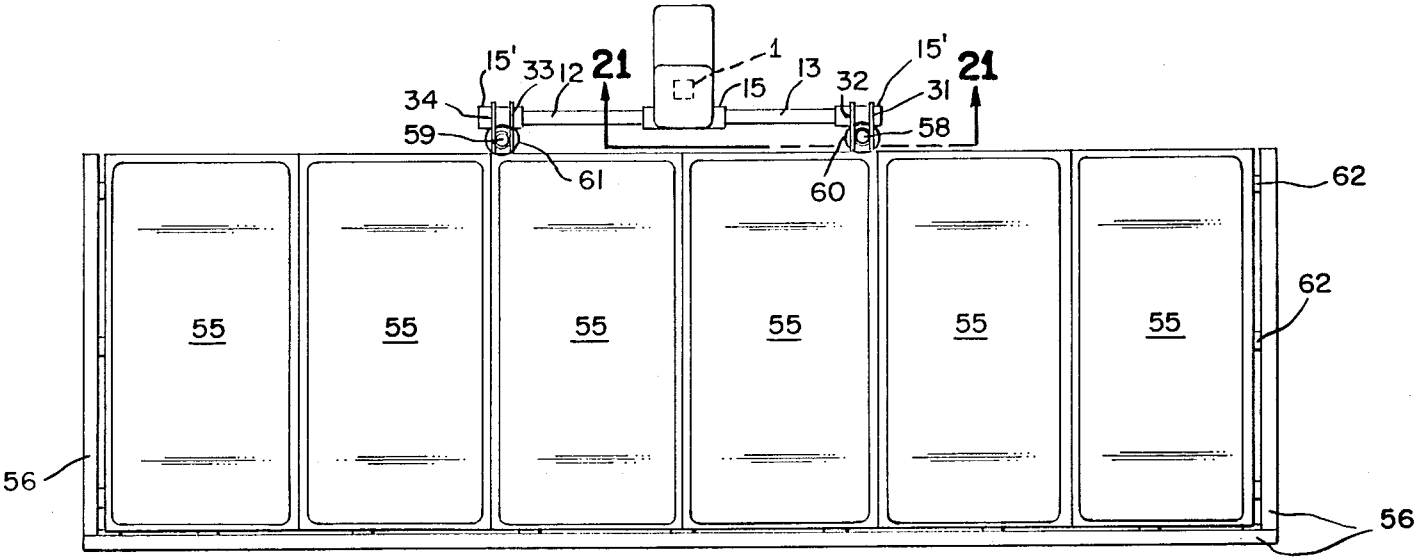
FIG. 7 is a plan view of another form of the lift for a floating dock.
Figure 8:
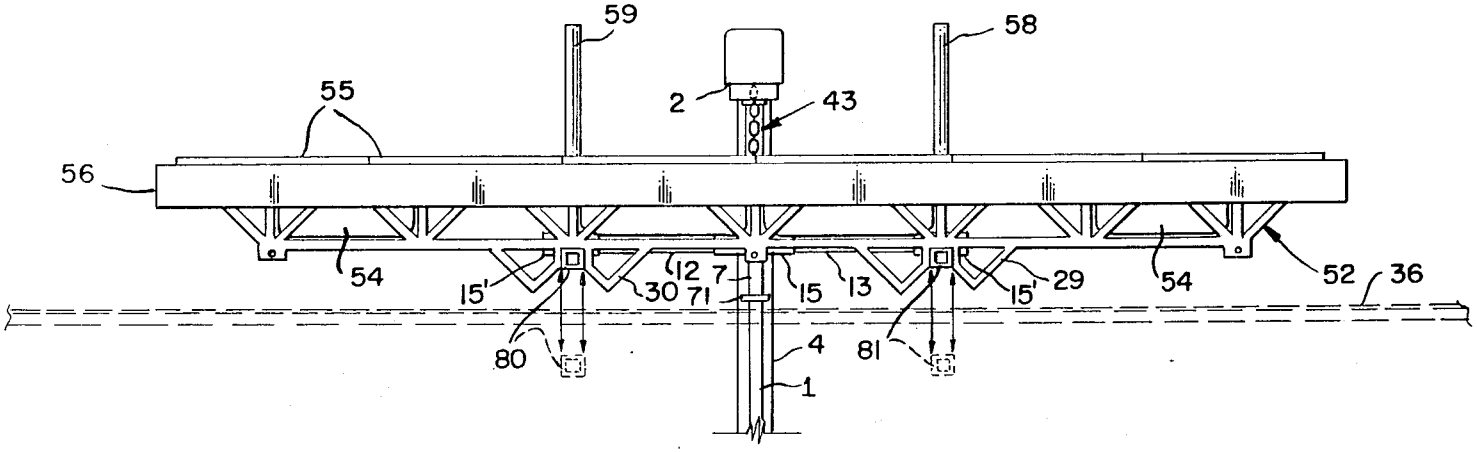
FIG. 8 is a front elevation of the lift shown in FIG. 7.
Figure 9:
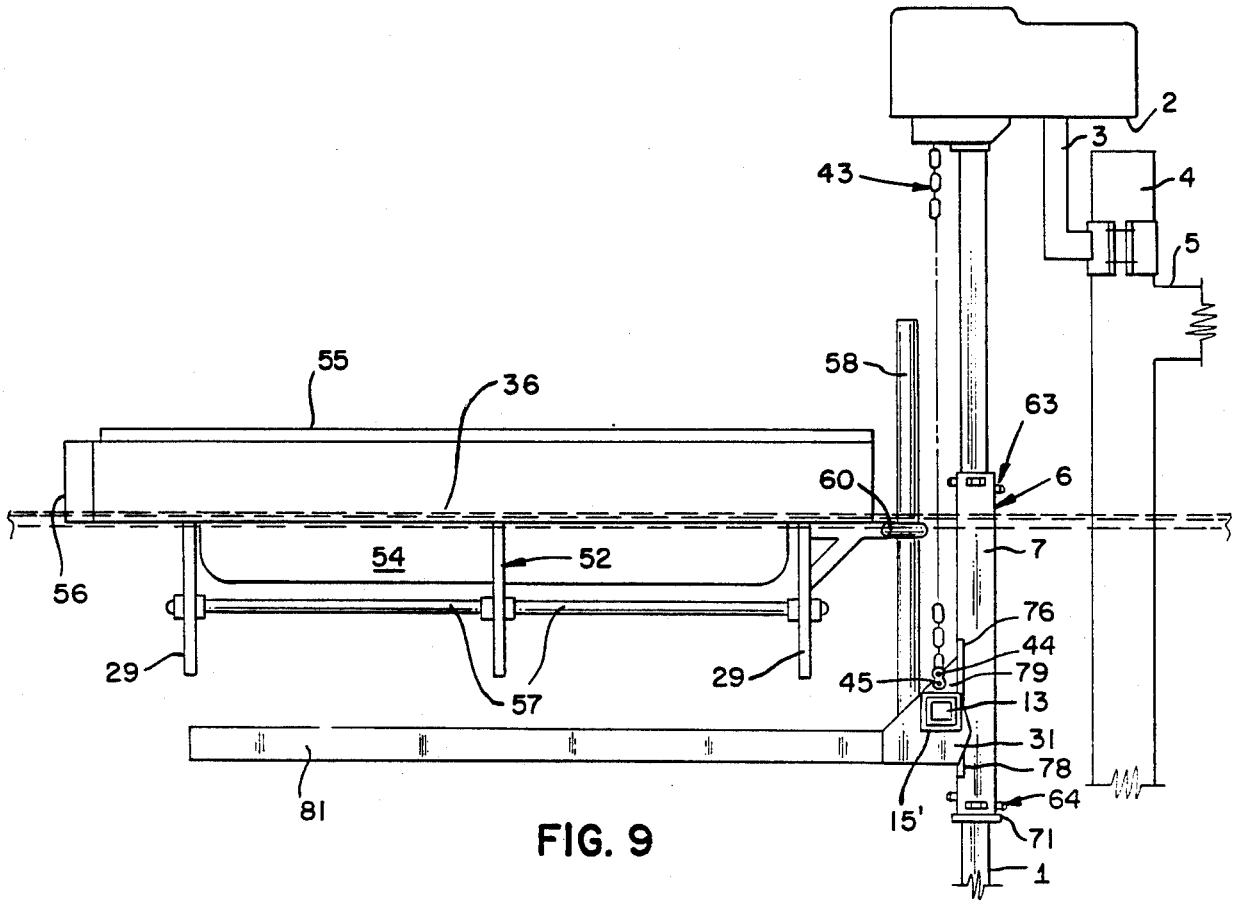
FIG. 9 is a side view of the lift shown in FIG. 7 with the lift lowered below the water surface and the platform floating.
Figure 10:
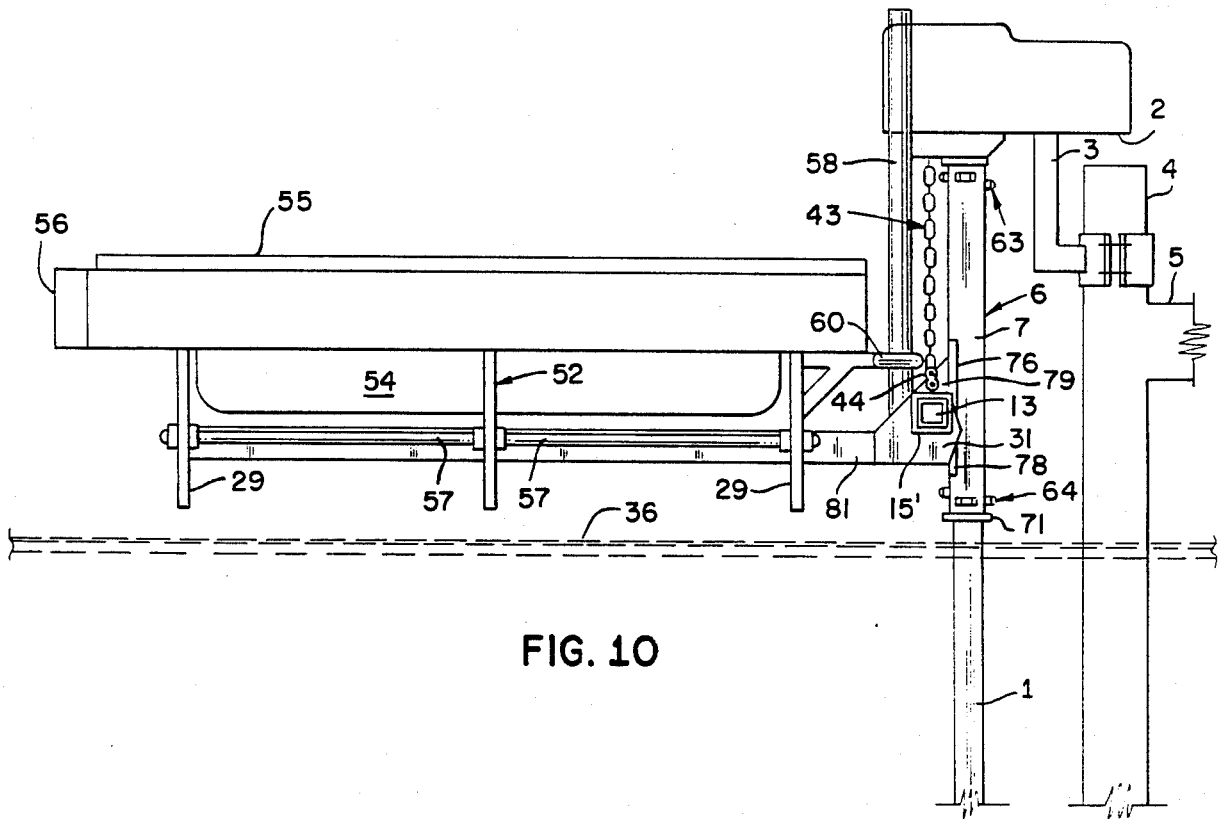
FIG. 10 is a side view of the lift, identical to FIG. 9 except that the platform is raised above the water.
Figure 11:
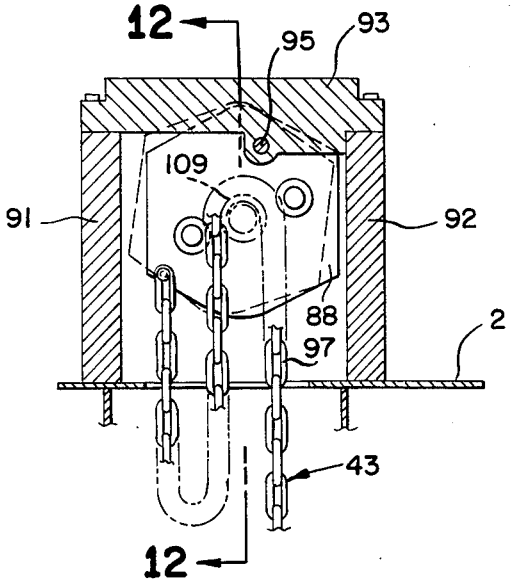
FIG. 11 is a cross sectional view of a portion of the chain lift taken along line 11—11 of FIG. 5.
Figure 12:
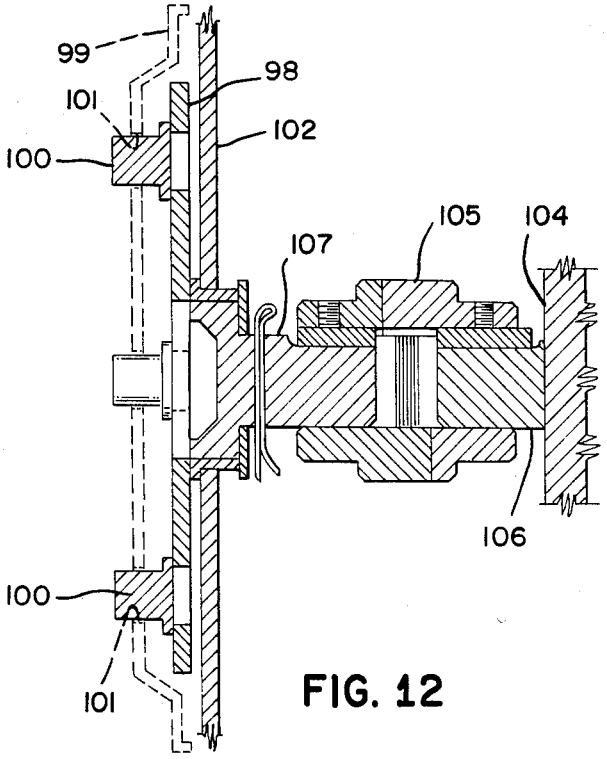
FIG. 12 is an enlarged cross section of a portion of the chain lift taken along line 12—12 of FIG. 11.

To insure free travel of the sleeve assembly 6 on the stanchion, upper and lower rollers assemblies 63 and 64 are mounted on each of the sleeve assemblies for rolling contact on the stanchion members as shown in FIG. 6. In the illustration, the stanchion inner sleeve is formed with upper side cutouts 65 and lower side cutouts 66. Guide roller blocks 67 are welded to the inner sleeve adjacent the openings and are formed with openings for holding the roller shafts 68 which hold upper guide rollers 69 and lower guide rollers 70. Since the guide rollers ride all four sides of the stanchion, the loads on the forks need not be perfectly balanced.

A bottom plate 71 welded to the inner sleeve lower end limits the lowermost movement of the inner sleeve, and prevents the inner sleeve from penetrating channel bottom silts.

The use of a chain hoist, also referred to as a chain fall provides automatic ratcheting of every point of elevation of the lift. The lift will hold at any position between fully down and fully up positioning. A safety latch, however, is preferably provided at the uppermost position. In addition, the automatic latching can provide a locking mechanism to prevent unauthorized use of the lift.

Chain falls are commonly used in industrial plants for lifting equipment and materials. In all instances known to Applicants, however, the chain falls is supported by a pivoting rotatable hook to a rigid member. In such installations, the hook permits the chain fall to be swiveled 360° and to pivot. Applicants found, however, that when a standard chain hoist was mounted on a fixed mounting, it would not operate. For this reason, Applicants constructed a yoke type structure consisting of yoke legs 91 and 92, and yoke cross member 93. A pivot opening is provided in the yoke cross member and a pin 95 pivotally connects the chain hoist 46 to the yoke cross member 93. Thus, depending on the load, the chain hoist pivots so that the lifting portion 97 of chain 43 is slightly outwardly of pivot pin 95 as shown in FIG. 6. The solid lines of plate 120 shows the position of the chain fall without load. The dashed line 120 show the position of the chain fall and plate under load.

Applicants found that a standard chain operated chain hoist was too slow and inconvenient for may persons with seaplanes. A standard hand operated chain hoist is used with the following modifications as shown in FIG. 5. The hand operated chain is removed and an adapter wheel 98 is mounted adjacent the hand operated chain wheel 99. A plurality of studs 100 are welded to the adapter wheel and the studs engage openings 101 in the hand chain wheel 99. A cradle 102 is connected to plate 88 of the chain hoist y bolts 103. An electric motor 47 and gear reducer 104 are mounted on cradle 102. Coupling 105 connects the gear reducer shaft 106 to the shaft 107 connected to the adapter wheel 98. It is understood that the cradle 102 with the electric motor, gear reducer coupling, shaft and adapter wheel all pivot with the chain hoist as load is imposed by the lifting chain about pin 95.

A chain bucket 108 is attached beneath the base plate and the chain hoist to receive and store the chain as it comes off the chain lifting wheel 109. Appropriate guides within the chain bucket ensure proper entry of the chain into the bucket and withdrawal when the lift is lowered.

As presently constructed, the lift is not cleared for lifting passengers as well as the seaplane or other watercraft. Should a watercraft owner remain in the craft, however, Applicants have provided metal guard plates 110 which encircle the base plate at the point of entry of the lifting chain. Should a person hold onto the lifting chain while the lift is being raised, his arm will bump against the metal guard plates and warn him to release his grip on the chain before it wraps around the chain wheel. Where the guard plates are made of substantial thickness, they also serve to stiffen the base plate and prevent it from warping under heavy loads.

Docking of a seaplane on the lift is simple and by following the steps set forth below, the plane automatically centers itself in the correct position for lifting. First, the target members 48 and 49 are adjustably slid along the cross arms 50 and 51 so that the seaplane will be in close alignment with the center line between the stanchion members.

The lift is now lowered to a position so that the pontoons will clear the dock members 24. The plane is then maneuvered into the correct position on the platform for lifting by use of the motor or by. hand. Tie down lines may be attached to the plane and the platform. The lift motor is now actuated and the plane is lifted out of the water. If no help is available, the pilot may wish to gently nudge the pontoons against the targets by keeping the propeller turning until the pontoons are lifted out of the water.

The watercraft may be lifted to any height and the ratchet mechanism of the chain lift will hold the craft so that it may be inspected, the pontoons cleaned, work done on the motor, or for any other purpose. The plane may be lifted to the upper limit as previously explained and latched and locked until ready for use once again.

When the lift is provided with an electric motor, a remote control unit can be attached to the base plate and a control unit similar to the electric control unit on a garage door opener can be used to operate the lift. Thus, when the craft is in the lifted position, a person with the remote controller can activate the motor to lower the craft even though he is still several yards from the craft. When he arrives at the dock, the plane will be floating in the water. He merely needs to cast off the lines and power away from the lift. Once clear of the lift, with his remote controller, and while still in the craft, he can cause the lift to be raised to its upper position free of the channel.

In returning to the lift, again, before reaching the lift, the remote controller can signal the latching mechanism to unlatch the latching pin and for the electric motor to lower the platform into the water. As the plane or craft approaches, any changes in the level of the water can be noted and the platform lowered to the approximately correct depth for lifting. Once the lines are secured to the platform, the pilot and passengers can disembark, either before or after the plane is lifted out of the water.

The lift may be outfitted with lights so that when the plane approaches the lift at night the plane can be easily positioned in relation to the forks.

The use of a remote control device to operate the electric motor of the lift permits the pilot to stay in the plane while operating the lift in the docking operation. Thus, when the lines have been secured, the remote controller can signal the lift to be raised until the plane is resting on the platform. While the pilot and passengers are still in the plane, the remote controller can signal the motor to raise the lift a few inches until the pontoons are stable on the lift. The operator and passengers can then leave the plane from a stable platform rather than from a unstable pontoon. The boat may now be raised to its upper position by the remote controller from the safety of the dock.

LIFTING DOCK (FLOATING)

A modified form of the invention is illustrated in FIGS. 7–10. A general purpose lifting dock is shown. A single stanchion is used with a lift mechanism identical to the mechanism just described. Identical numbers are used on identical parts. The dock can be constructed with or without floats. The dock with floats is described first.

The dock lift is supported on a single load bearing stanchion member 1 which may be a ⅜" wall 5" by 5" square tube. A base plate 2 of considerable rigidity, such as a ½" steel plate is seated on the top of the stanchion and suitably braced. A bracket member 3 is connected to the base plate laterally disposed from the stanchion member and is adapted for connection to a stabilizing member 4. The size and configuration of the bracket will depend upon whether the stanchion is to be stablized by an existing pier 5 or by another member 4 driven into the lake or river bottom. The stablizing bracket must also be engineered depending upon the stability of the stanchion to resist lateral forces. In some instances, the stanchion will be driven into the lake or stream bottom while in other installations it may be anchored in a foundation.

Figure 21:
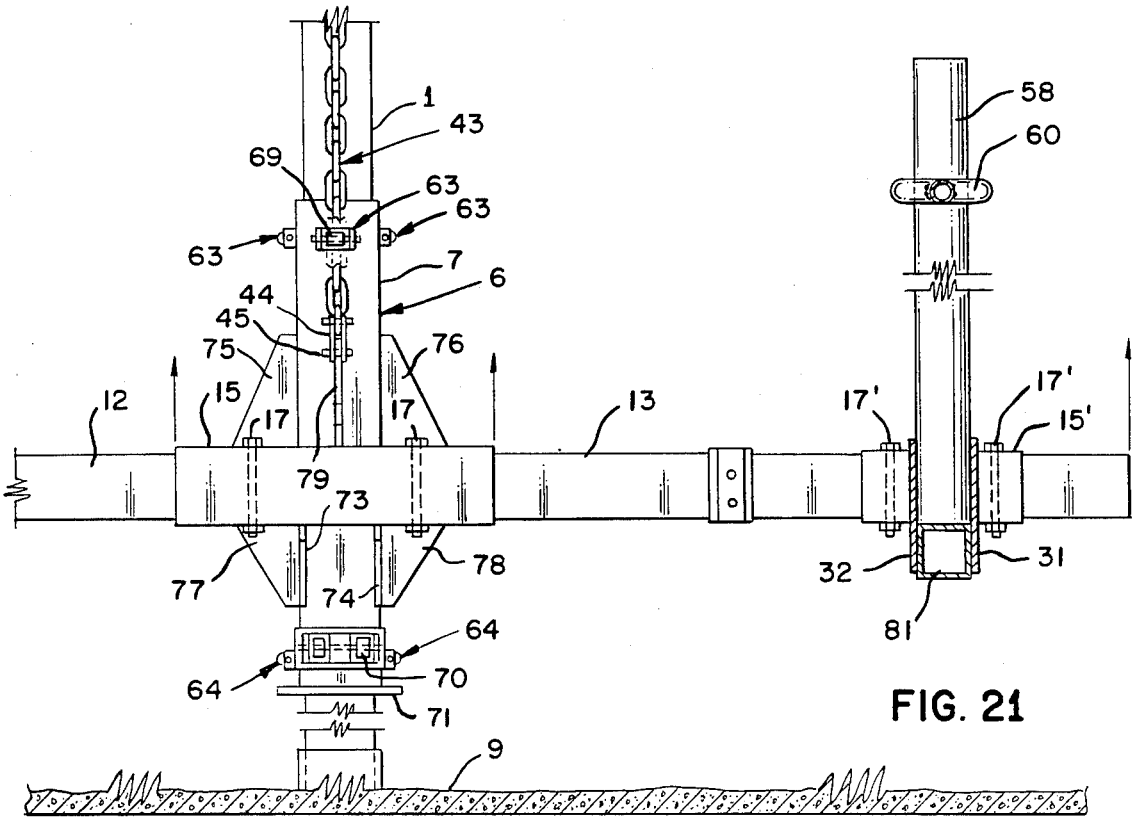
FIG. 21 is a sectional view of a portion of the lift shown in FIG. 7 taken along line 21—21.

Referring to FIGS. 7,8,9,10 and 21 a sleeve assembly 6 is slidably mounted on the stanchion member for travel thereon. The sleeve assembly here consists of an inner sleeve 7 which surrounds the stanchion and is constructed from ⅜" wall tube 6"×6"×4' and distributes the moment load on the stanchion. As shown in FIG. 21 lower braces 73 and 74 and side braces 75, 76, 77 and 78 and lifting flange 79 are welded to the inner sleeve 7 and to cross bar sleeve 15. The cross bar sleeve 15 holds cross arm members 12 and 13 which may be constructed from ⅜" wall steel tube 5"×5" and extend laterally substantially equidistant on either side of the stanchion. Preferable, cross arms 12 and 13, which may be a single member, is mounted on the cross bar sleeve 15 for sliding movement. Pins or bolts 17 secure the cross arm to the cross bar sleeve after the cross arm has been positioned. The adjustable cross bar is to insure that the load is evenly distributed with respect to the stanchion to reduce twisting of the cross bar sleeve and imparting a moment load to the stanchion.

A pair of fork members 80 and 81 are connected to the cross arms 12 and 13 by outer cross bar sleeves 15' disposed on opposite sides of the stanchion member 1. Pins 17' connect outer sleeves 15' to cross arms 12 and 13. The forks may be $\frac{3}{8}''\times4''\times4''$ tube$\times6'6''$ and are preferably releasably connected to brackets 29 and 30 mounted on the underside of the dock. To enable the dock lift to raise water craft in as shallow water as possible, the fork brace members 31, 32, 33 and 34 are mounted below the cross arms 12 and 13 and are connected to the fork members 80 and 81 as shown in FIGS. 7, 8, 9, 10 and 21.

Brackets 29 and 30 are constructed with an opening so that forks 18 and 19 can be lowered below the space frame so that the dock floats freely above the forks.

A lifting member 43 is connected to the sleeve assembly 6 and may be a cable or preferably a chain. The chain 43, as shown in FIG. 21 may be attached to a coupling 44 which is connected to a pin 45 inserted through an opening in lifting flange 79.

The chain is operatively connected to a mechanical multiplying means 46 previously described and illustrated in FIGS. 5, 6, 11 and 12.

To insure free travel of the sleeve assembly 6 on the stanchion, upper and lower roller assemblies 63 and 64 are mounted on the sleeve assembly 7 for rolling contact on the stanchion member 1 as previously described.

A bottom plate 71 welded to the lower end of inner sleeve 7 limits the lowermost movement of the inner sleeve, and prevents the inner sleeve from penetrating channel bottom silts.

The use of a chain hoist, also referred to as a chain fall provides automatic ratcheting of every point of elevation of the lift. The lift will hold at any position between fully down and fully up positioning. A safety latch, however, is preferably provided at the uppermost position. In addition, the automatic latching can provide a locking mechanism to prevent unauthorized use of the lift.

The lifting dock may be constructed in several different ways and the dock illustrated in FIGS. 7–10 is merely one way of making the dock. A space frame 52 supports and cradles foam filled fiberglass floats 54. Fiberglass deck panels 55 are connected to the floats 54. Wood or rubber boat bumpers 56 protect the edges of the space frame 52. Shock absorbers 62 should be placed between the bumpers and the frame. Tie rods 57 hold the members of the space frame. Vertical guides 58 and 59 are connected to braces 31–34. Slip rings 60 and 61 connected to the space frame surround vertical guides 58 and 59 and steady the dock. The main purpose of the guides 58 and 59 and slip rings 60 and 61 is to permit the dock to float freely when the fork members are lowered below and free of the space frame. The dock is then fully supported by the foam filled floats and is prevented from floating free of the lift by the guides and slip rings. Boats moored to the dock will not be damaged since the dock is free to rise and fall with the boat. To protect the dock from wave damage, the dock can be lifted above the water level for storage.

NON-FLOATING DOCK

Figure 13:
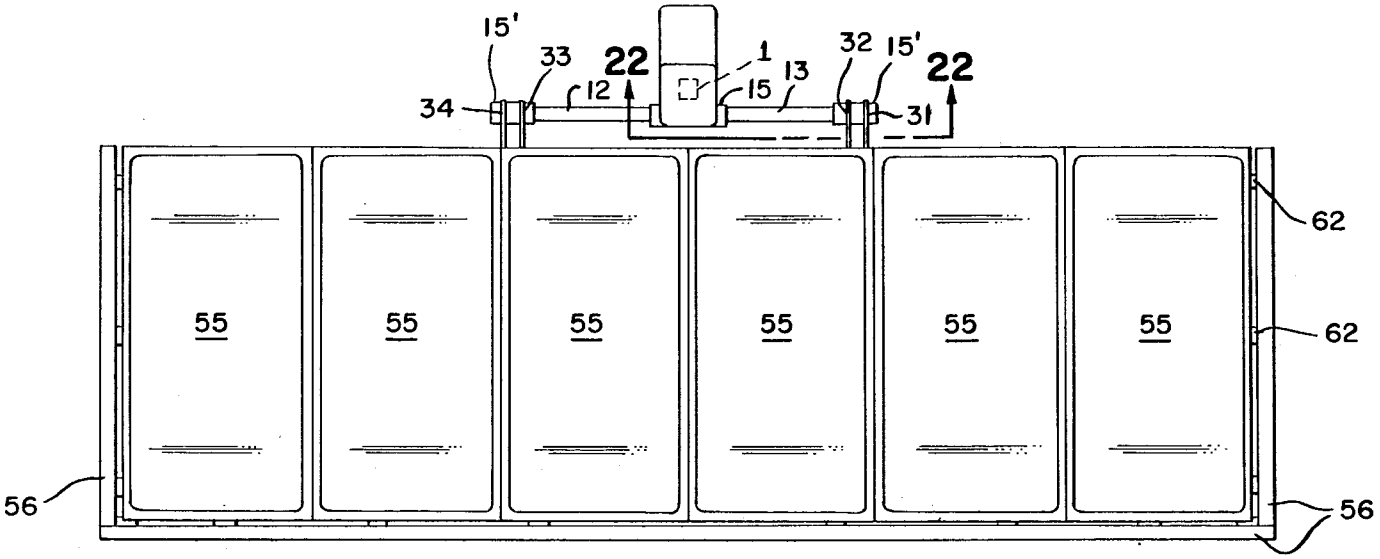
FIG. 13 is a plan view of another form of lift for a non-floating dock.
Figure 14:
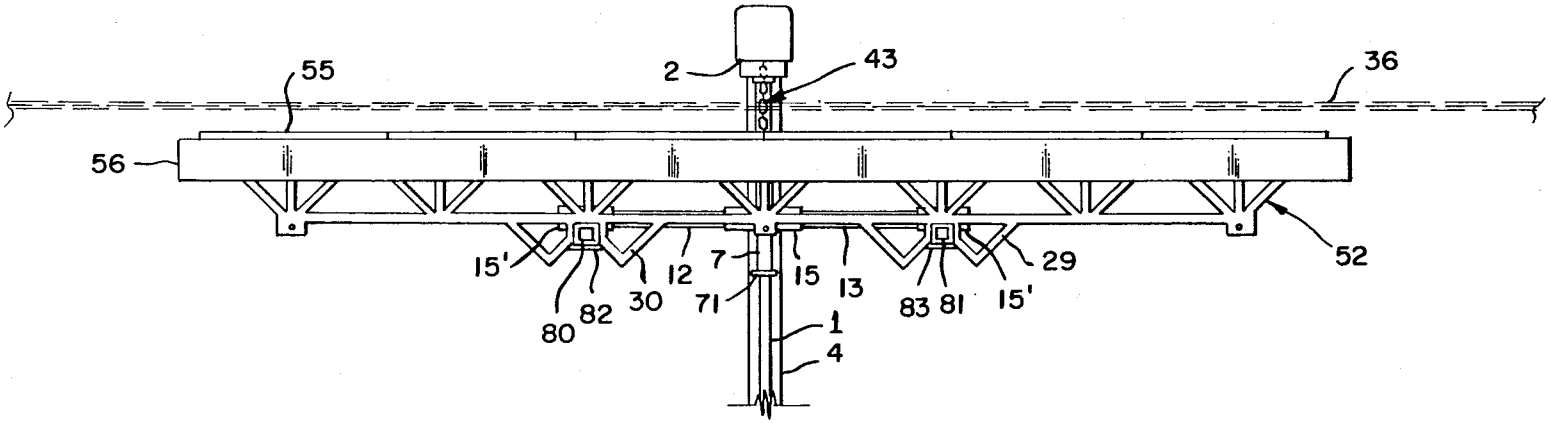
FIG. 14 is a front elevation view of the lift and non-floating dock shown in FIG. 13.
Figure 15:
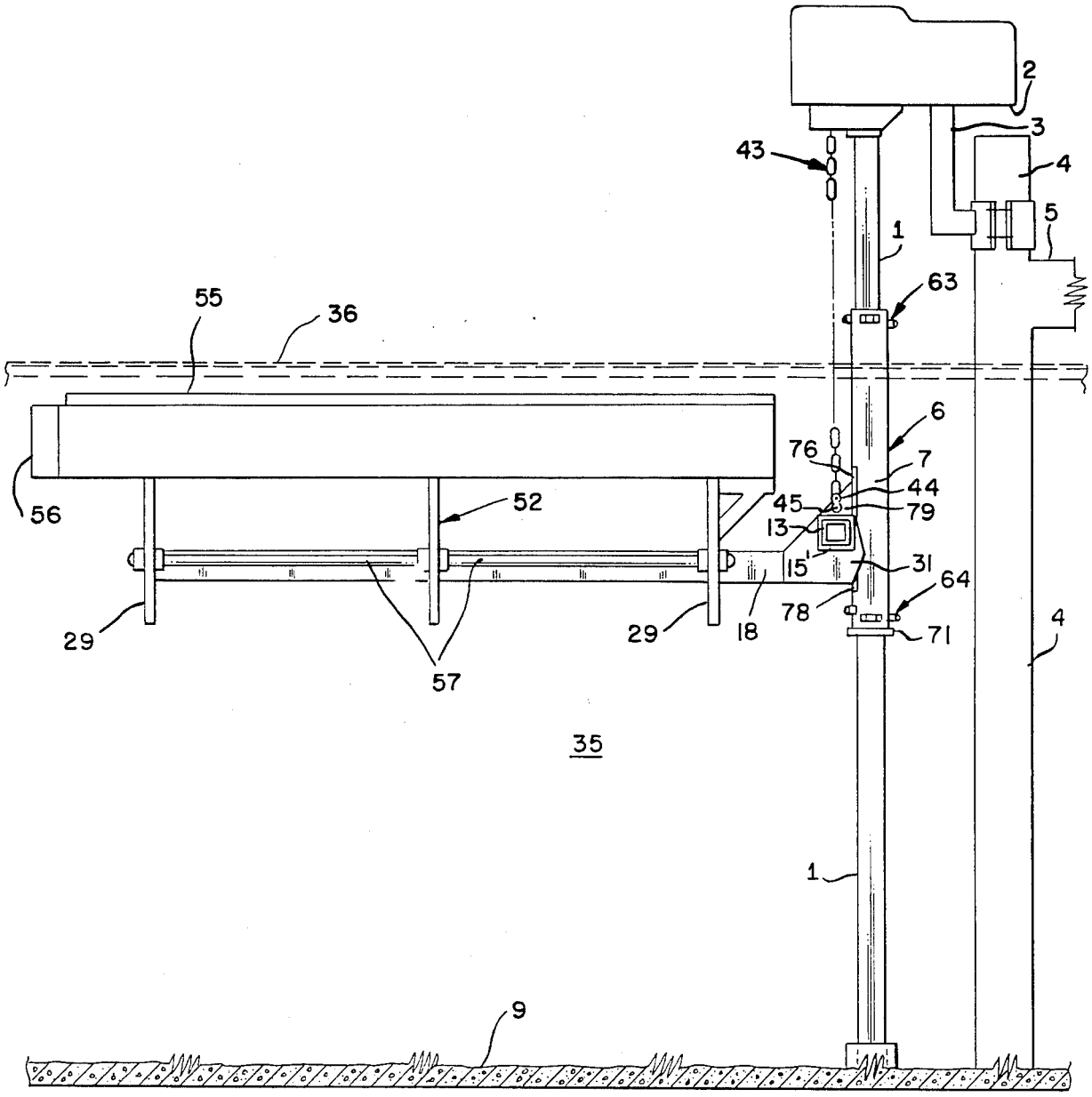
FIG. 15 is a side view of the lift shown in FIG. 13.
Figure 16:
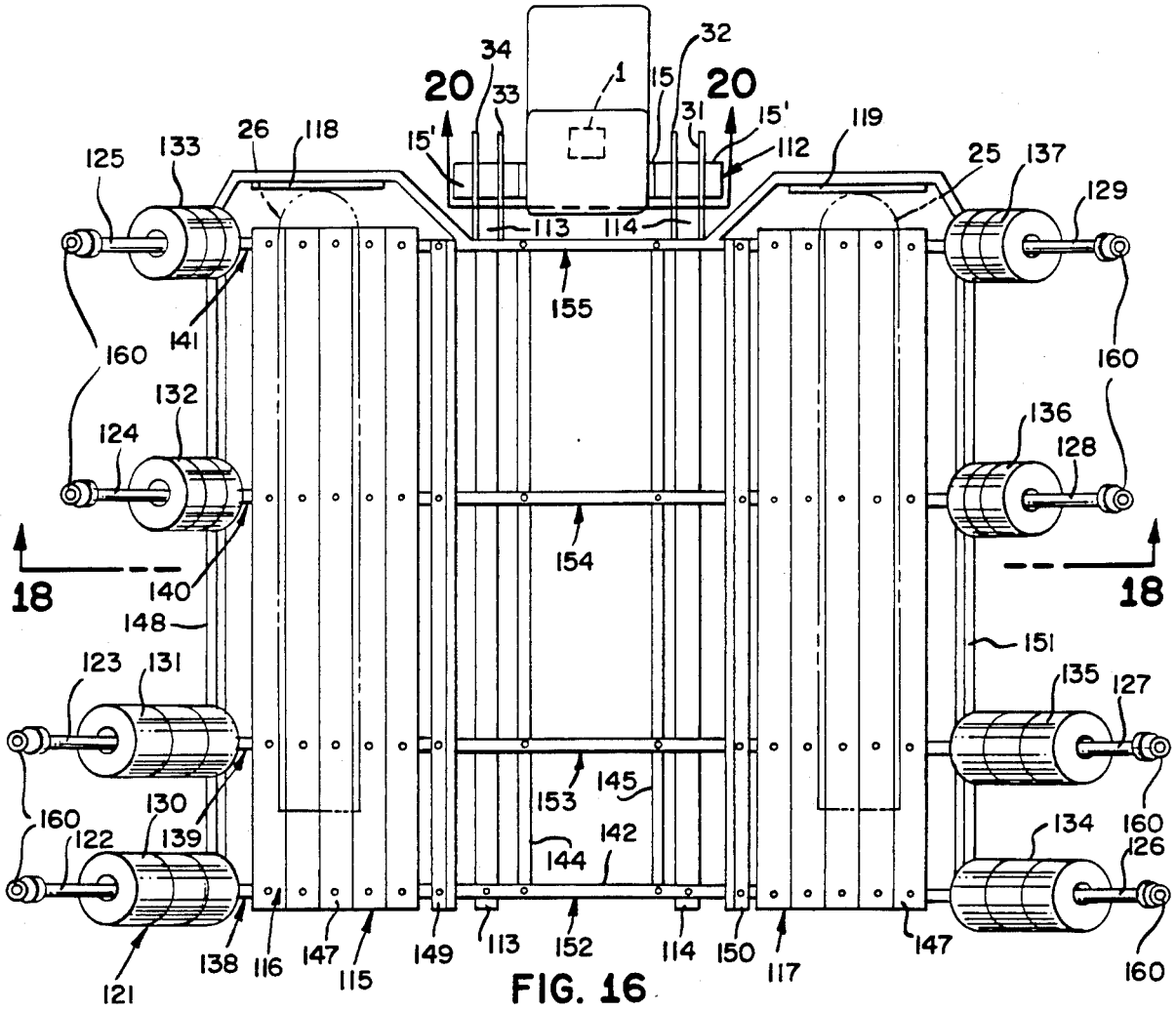
FIG. 16 is a modified form of the invention illustrating a single stanchion seaplane lift.

In still another form of the invention, as illustrated in FIGS. 13, 14 and 15 the foam filled floats 54 are deleted from the space frame. In this form of the invention, the dock can actually be lowered below the surface of the water so that small flat bottomed boats, ski-doos or twin hulled craft can be positioned over the submerged dock and picked up out of the water.

Docking the watercraft such as a twin hull or flat bottom boat or ski-doos on the lifting dock is simple.

The lift is lowered to a position so that the hull will float above the dock panels. The craft is then maneuvered close to the center of the dock for lifting by use of the motor or by hand. Lines may be attached to the dock. The lift motor is now actuated and the craft is lifted out of the water.

The boat may be lifted to any height and the ratchet mechanism of the chain lift will hold the boat so that it may be inspected, the hull cleaned, work done on the motor, or for any other purpose. The watercraft may be lifted to the upper limit as previously explained and latched and locked until ready for use once again.

When the lift is provided with an electric motor, a remote control unit can be attached to the base plate and a control unit similar to the electric control unit on a garage door opener can be used to operate the lift. Thus, when the craft is in the lifted position, a person with the remote controller can activate the motor to lower the dock even though he is still several yards from the craft. When he arrives at the craft, the boat will be floating in the water or resting on the dock which is floating. He merely needs to cast off the lines, lower the dock below the surface and power or sail away from the lift. Once clear of the lift, with his remote controller, and while still in the craft, he can cause the lift to be raised to its upper position free of the channel.

In returning to the lift, again, before reaching the lift, the remote controller can signal the latching mechanism to unlatch the latching pin and for the electric motor to lower the forks into the water. As the boat approaches, any changes in the level of the water can be noted and the forks and dock lowered to the approximately correct depth to permit the craft to float above the dock. Once the lines are secured to the dock, the dock can be raised and the passengers can disembark upon the dock. Once out of the boat, the controller can be actuated and the boat and dock lifted out of the water.

The lift may be outfitted with lights so that when the boat approaches the lift at night, the boat can be easily positioned in relation to the dock.

The non-floating dock in FIGS. 13–15 and 22 is constructed essentially the same as the floating dock illustrated in FIGS. 7–10 and 21 except for the deletion of the floats as previously mentioned and the deletion of the upright posts 58 and 59 and slip rings 60 and 61. Like parts have been given identical numbers. Since the dock is non-floating, tie members 82 and 83 secure the fork members 80 and 81 to the brackets 29 and 30 as shown in FIG. 14.

Figure 22:
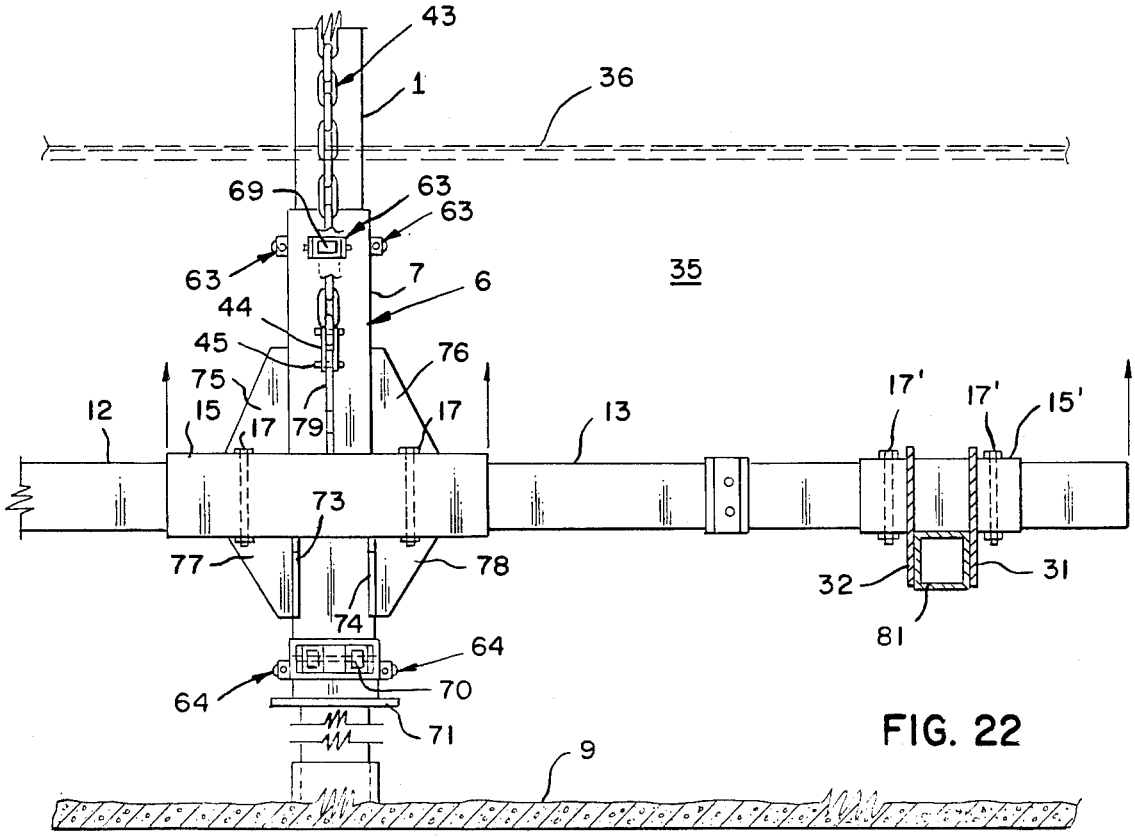
FIG. 22 is a sectional view of a portion of the lift shown in FIG. 13 taken along line 22—22.

As shown in FIG. 22, the lifting mechanism and fork members are identical to the structure shown in FIG. 21. Pins 17' connect outer cross bar sleeves 15' to cross arms 12 and 13.

The use of a remote control device to operate the electric motor of the lift permits the boat operator to stay in the boat while operating the lift in the docking operation. Thus, when the lines have been secured to the dock, the remote controller can signal the lift to be raised until the boat is resting on the boat dock. While the boat operator and passengers are still in the boat, the remote controller can signal the motor to raise the lift a few inches until the boat is stable on the dock. The operator and passengers can then leave the boat from a stable platform rather than from a floating boat. A cover can then be placed over the boat if necessary, while the boat is in a stable secure position. The boat may now be raised to its upper position by the remote controller from the safety of the dock.

SINGLE STANCHION SEAPLANE LIFT

FIGS. 16–20 illustrate another form of the invention. The seaplane lift shown is constructed with a single stanchion 1 which is driven into the soil 9 or anchored in a suitable foundation beneath a body of water 35 having a water level 36. The lift is particularly suited for seaplanes having twin pontoons 25 and 26.

There is no danger that the propeller will strike the single stanchion since the seaplane is carefully guided onto the platform and special pontoon bumper stops prevent the seaplane from moving too far forward on the lift.

The single stanchion 1 and the lifting mechanism is identical to the stanchion and lifting mechanism illustrated in FIGS. 7–15, 21 and 22, and the description is not repeated. Like parts are given identical numbers.

Briefly, the seaplane lift illustrated in FIGS. 16–20 consists briefly of a single stanchion load bearing member 1 anchored in soil 9 or a foundation, a base plate 2 connected to the top of the stanchion; a bracket member 3 connected to the base plate laterally disposed from the stanchion member and adapted for connection to stabilizing member 4, a sleeve assembly 6 slidably mounted on the stanchion member for travel thereon; a cross arm means 112 connected to the sleeve assembly 6 and extending laterally substantially equidistant on either side of said stanchion; fork members 113 and 114 connected to cross arm means 112 and disposed on opposited sides of the stanchion member; a platform means 115 mounted on the fork members 113 and 114 having pontoon platforms 116 and 117 adapted for supporting twin pontoons 25 and 26 of a seaplane; a lifting member 43 connected to the sleeve assembly 6; mechanical multiplying means 46 mounted on the stanchion member 1 and connected to the lifting member 43; target pontoon bumpers 118 and 119 mounted on platform means 115 forwardly of the pontoon platforms for limiting the forward movement of the seaplane pontoons 25 and 26; and pontoon guide means 121 mounted on the platform means 115 on opposite sides of the pontoon platforms 116 and 117 for limiting lateral movement of the pontoons 25 and 26.

Briefly, the pontoon guide means 121 include a plurality of upright members 122–129 spaced adjacent the pontoon platforms 116 and 117 and buoyant fender means 130–137 slidably mounted on each of the upright members for upward free sliding movement.

Figure 17:
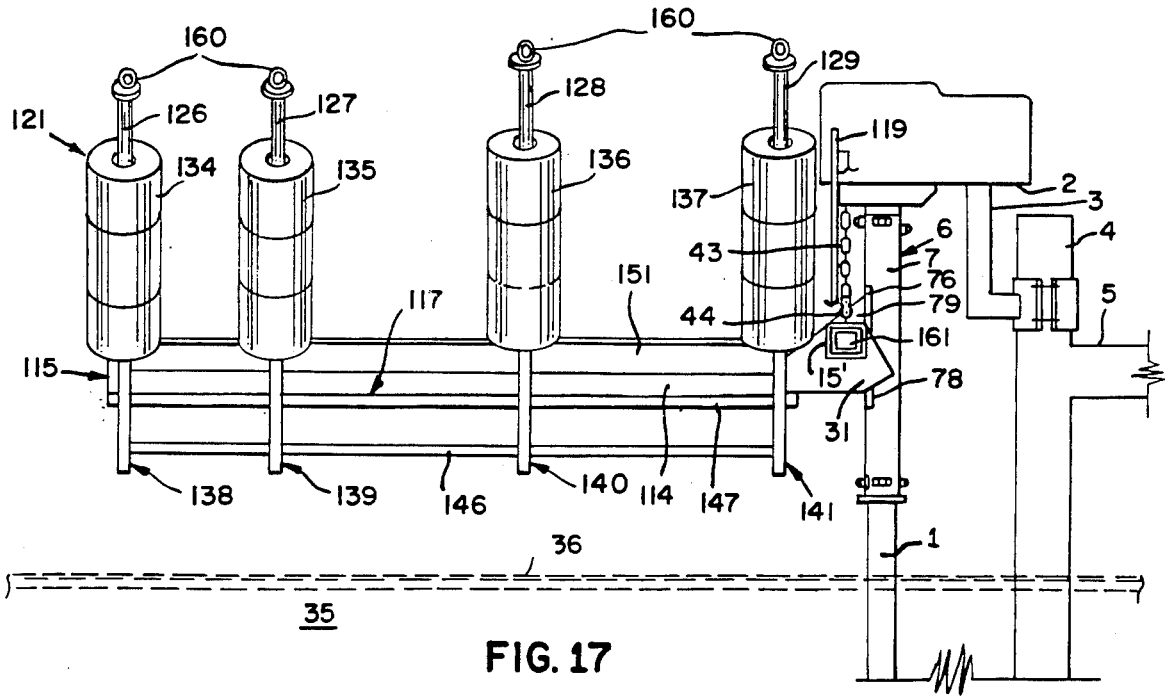
FIG. 17 is a side view of the lift shown in FIG. 16.
Figure 20:
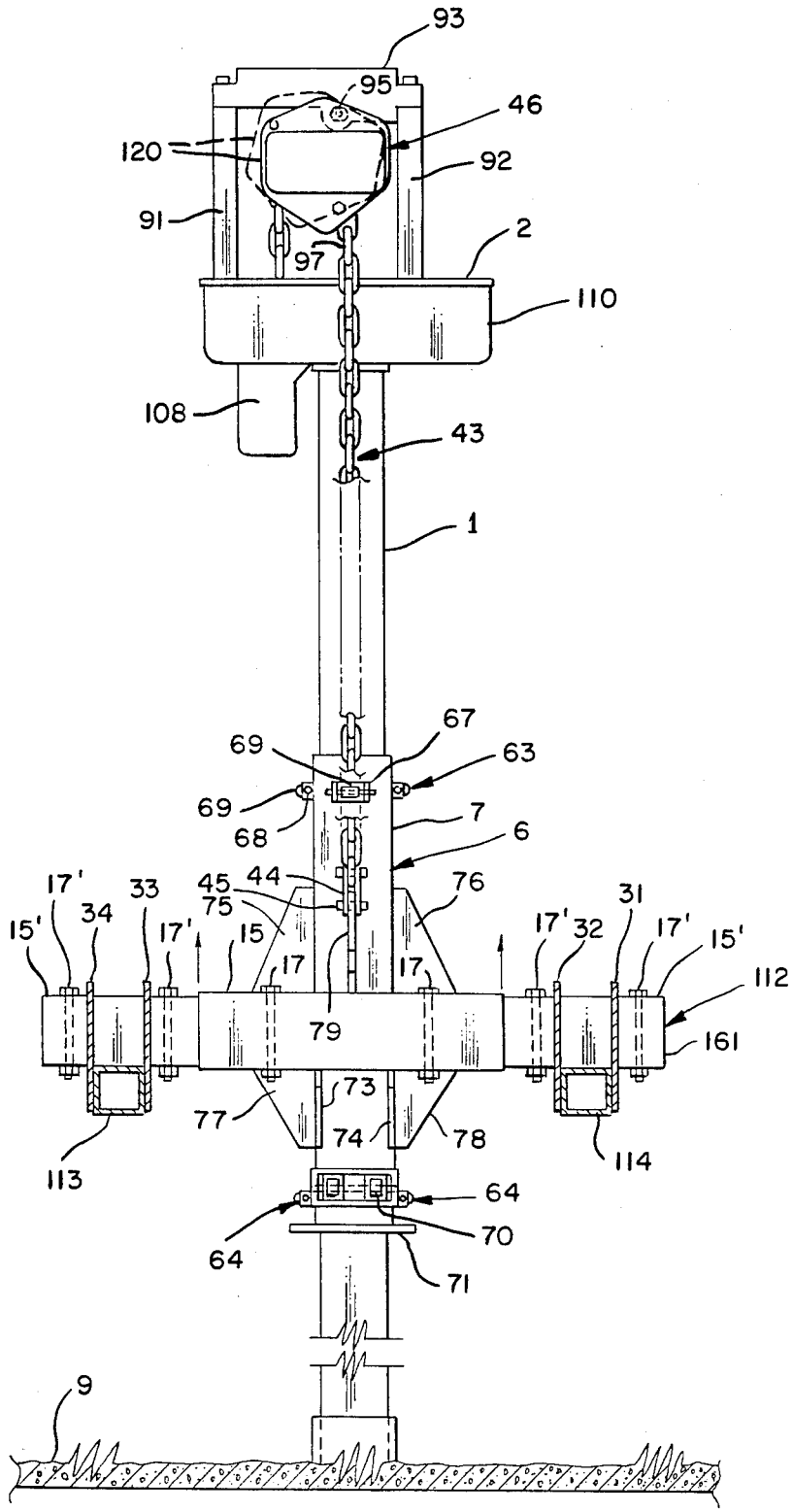
FIG. 20 is a sectional view of a portion of the lift shown in FIG. 16 taken along line 20—20.

Cross arm means 112 may consist of either a single or double rectangular tubular member 161 which is slidably received within cross bar sleeves 15 and 15' as best shown in FIGS. 17 and 20. When the cross arm means is adjusted, pins 17 and 17' lock the cross arm means 112 to the cross bar sleeves 15 and 15'.

Fork members 113 and 114 are connected to the cross arm means by means of braces 31–34 which are formed with rectangular openings for receipt of cross bar sleeves 15'. The braces 31–34 are then welded to the cross bar sleeves 15' and to the fork members 113 and 114.

The platform means 115 briefly consists of space frames 138–141 which are made up from 2"×2"×3/16 steel tubular members 142 in a truss pattern. Longitudinal members 143–146 are connected to the space frame members. Additional rigidity is imparted to the platform means by forming the pontoon platforms 116 and 117 from plank members 147. Further rigidity is provided by guide planks 148–151 bolted to the space frames 138–141.

Figure 18:
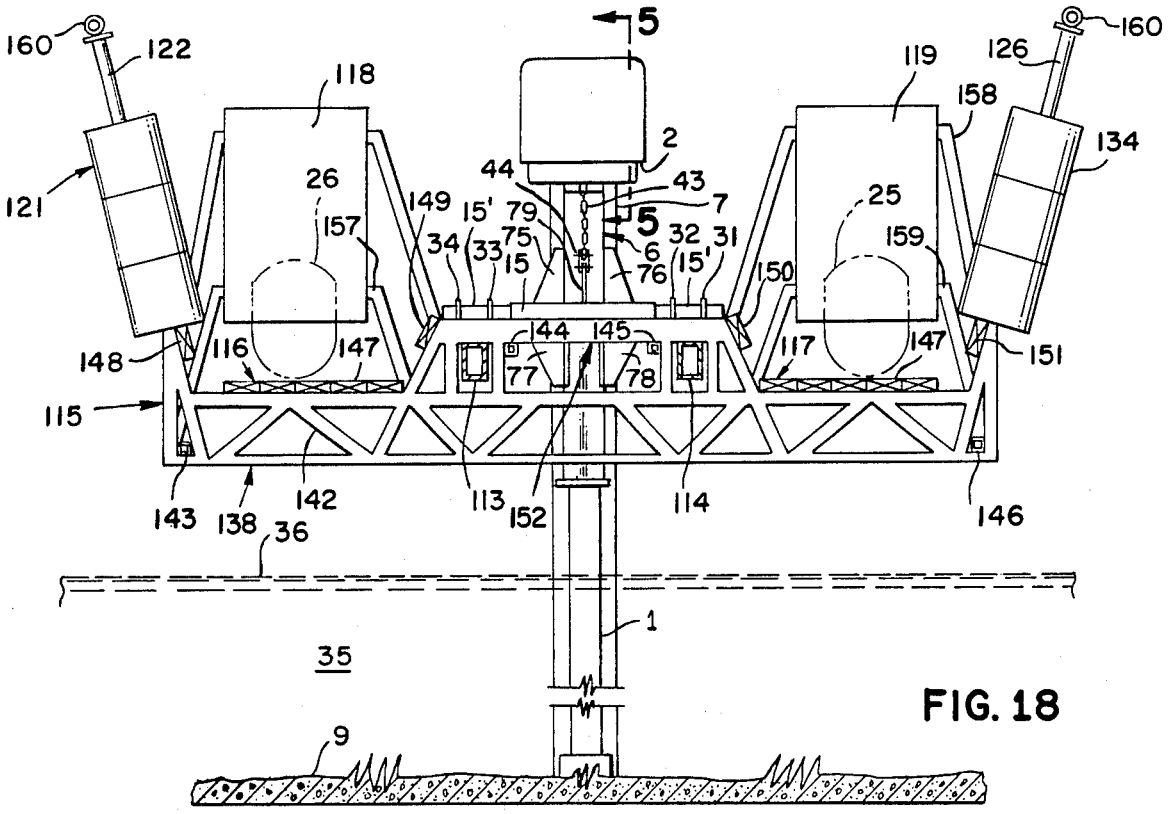
FIG. 18 is a front view of the lift shown in FIG. 16 taken along line 18—18 of FIG. 16.

The center of gravity of the plane is lowered with reference to the fork members 113 and 114 by providing lift beams 152–155 at the highest portion of the space frames 138–141. As shown in FIG. 18, the fork members 113 and 114 are cradled within an opening in the space frame formed by lift beams 152–155, and various vertical and horizontal tubular members 142 forming the space frames.

The target pontoon bumpers 118 and 119 are supported by standard means by tubular members 156–159. The target pontoon bumpers may be constructed from plywood, plastic sheets or light guage metal.

It is intended that skillful pilots will be able to dock on the platfonm under power. The pontoon guide means 121 are preferably constructed from a resilient material which may or may not be buoyant. So that the pilot will have some allowance for error, the pontoon guide means 121 are supported on upright members 122–129 mounted at varying angles. Thus upright members 122 and 134 which are at the entrance to the lift are tilted outwardly at the greatest angle, and the tilt is progressively reduced in the other upright members in direct proportion to the nearness to the front of the lift. As shown in drawing FIGS. 16–19, the fender means 130–137 are made from a buoyant material such as foam plastic and constructed with an opening in each of their centers. Thus, if the lift is lowered below the surface 36 of the body of water, the fender means will rise on the upright members 122–129 so that they will always serve to guide the seaplane pontoons onto the lift.

Docking of a seaplane may be accomplished in either of two ways. First, the lift may be lowered so that the pontoon platforms 116 and 117 will be submerged in the body of water so that plank members 147 are below the lower most part of the seaplane pontoon. The pilot then powers the seaplane between the pontoon guides 121 until the front tips of the pontoons 25 and 26 touch the target pontoon bumpers 118 and 119. While maintaining forward power, the lift is raised until the pontoon platforms are above the water and the pontoons are no longer buoyant. The pilot and passengers can then step out on the pontoons 25 and 26 and then onto pontoon platforms 116 and 117. The plane can then be moored to rings 160 fonmed in the upright members 122–129 or other suitable anchors. The pilot and passengers can then step out onto the dock or into a boat. The lift is then raised until the entire platform is above the highest point that the water is expected to rise.

Figure 19:
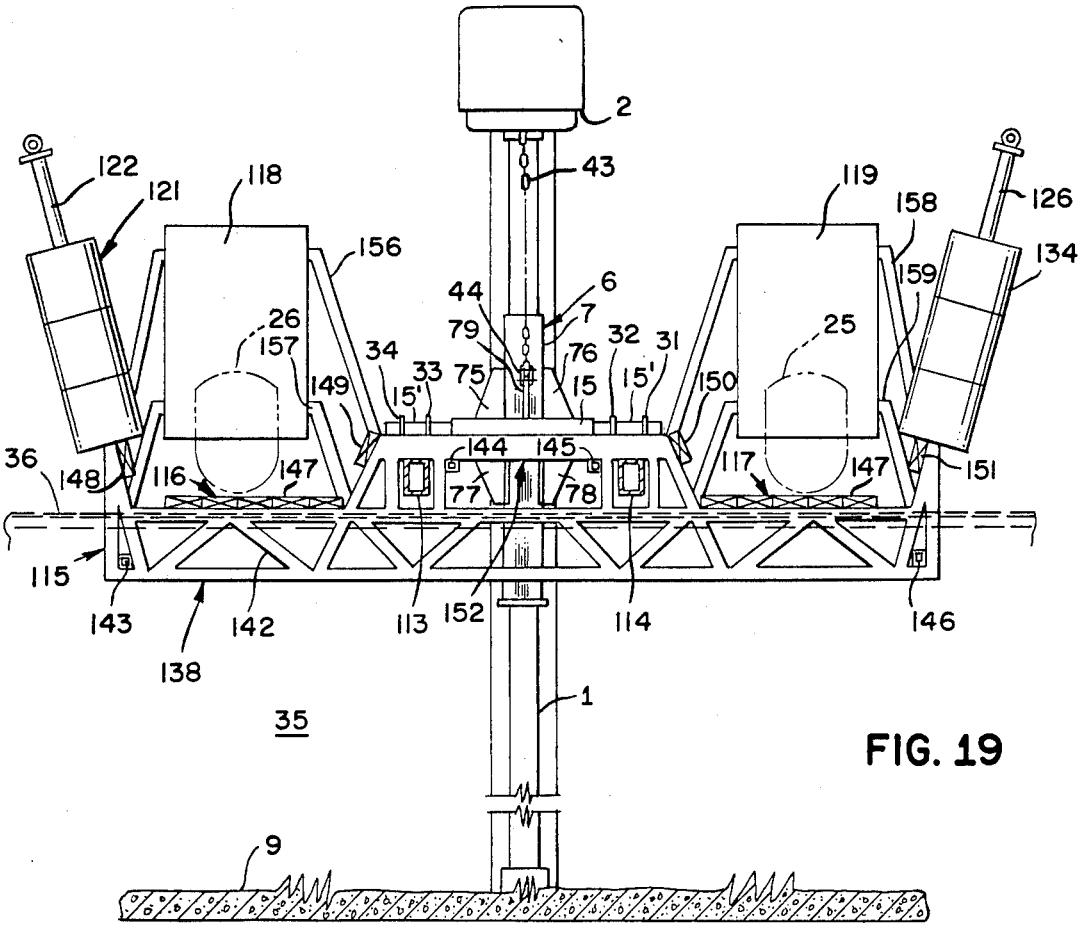
FIG.19 is a front view of the lift shown in FIG. 16 lowered into the water.

Another way of docking a seaplane is to position the plank members 147 of the pontoon platforms 116 and 117 slightly above the level 36 of the body of water 35 as shown in FIG. 19 and below the top of the pontoons 25 and 26. Since the fronts of all pontoons are curved gently upwardly, the pilot simply edges the front of the pontoon against the front of the pontoon platform. When he knows he has made contact with the lift and is properly aligned, he simply powers the plane up and onto the pontoon platforms. The advantage of this procedure is that the plane is immediately stabilized by the lift. This is important in docking during high winds or rough water.

We claim:

1. A watercraft lift mounted in the soil beneath a body of water comprising:

(a) A pair of laterally spaced free standing load bearing stanchion members engaging the soil beneath said body of water;
(b) a base plate connected to the top of each of said stanchions;
(c) a bracket member connected to each of said base plates laterally disposed from said stanchion members and adapted for connection to a stablizing member;
(d) a sleeve assembly slidably mounted on each of said stanchion members for travel thereon;
(e) a fork member connected to each of said sleeve assemblies and extending laterally from said stanchion members and generally parallel to each other;
(f) a platform connected to each of said fork members extending laterally between said stanchions for engaging said watercraft;
(g) a lifting member connected to said sleeve assembly; and
(h) mechanical multiplying means mounted on said stanchion members and connected to said lifting member for lifting substantially said entire platform above said body of water.

2. A watercraft lift as described in claim 1 comprising:
(a) a pair of docking targets connected to said platform, and
(b) a plurality of upright members connected to at least two sides of said platform; and
(c) buoyant fender means slidably mounted on each of said upright members for upward free sliding movement.

3. A watercraft lift as described in claim 1 comprising:
(a) power means connected to said mechanical multiplying means.

4. A watercraft lift as described in claim 1 wherein:
(a) said platform includes a pair of parallel fork sleeves; and
(b) said fork members are dimensioned and positioned for slidable registration with said fork sleeves.

5. A watercraft lift as described in claim 1 wherein:
(a) said sleeve assemblies include upper and lower roller assemblies mounted for rolling contact on said stanchion members.

6. A watercraft lift as described in claim 1 comprising:
(a) said lifting means is a linked chain; and
(b) said mechanical multiplying means is a chain fall.

7. A watercraft lift as described in claim 6 comprising:
(a) a yoke member connected to each of said base plates;
(b) said chain falls are pivotally connected to said yoke members;
(c) said chain falls include a chain drive power wheel;
(d) an adapter member connected to each of said power wheels; and
(e) an electric motor operatively connected to each of said adapter members.

8. A floating dock lift mounted in the soil beneath a body of water comprising:
(a) a single stanchion load bearing member driven into the earth or anchored in a foundation;
(b) a base plate connected to the top of said stanchion;
(c) a bracket member connected to said base plate laterally disposed from said stanchion members and adapted for connection to a stabilizing member;
(d) a sleeve assembly slidably mounted on said stanchion member for travel thereon;
(e) cross arms connected to said sleeve assembly and extending laterally substantially equidistant on either side of said stanchion;
(f) a pair of fork members connected to said cross arms and disposed on opposite sides of said stanchion member;
(g) a floating dock providing a platform for the receipt of a watercraft;
(h) bracket means mounted on the underside of said dock adapted for cradling said fork members;
(i) a lifting member connected to said sleeve assembly; and
(j) mechanical multiplying means mounted on said stanchion member and connected to said lifting member for lifting substantially said entire floating dock and watercraft above said body of water.

9. A floating dock lift as described in claim 8 comprising:
(a) a pair of guide posts connected to said cross arms on opposite sides of said stanchion member;
(b) slip rings mounted on said dock for sliding registration with said guide posts;
(c) buoyant means mounted on said dock; and
(d) each of said bracket means on said dock is constructed with an open channel to permit said forks to move below said dock and to permit said dock to float free of said forks and be held laterally only by said guide posts and slip rings.

10. A floating dock lift as described in claim 8 comprising:
(a) said lifting means is a linked chain; and
(b) said mechanical multiplying means is a chain fall.

11. A floating dock lift as described in claim 10 comprising:
(a) a yoke member connected to said base plate;
(b) said chain fall is pivotally connected to said yoke member;
(c) said chain fall includes a chain drive power wheel;
(d) an adapter member connected to said power wheel; and
(e) an electric motor operatively connected to said adapter member.

12. A non-floating platform lift comprising:
(a) a single stanchion load bearing member mounted in soil beneath a body of water;
(b) a base plate connected to the top of said stanchion;
(c) a bracket member connected to said base plate laterally disposed from said stanchion member and adapted for connection to a stabilizing member;
(d) a sleeve assembly slidably mounted on said stanchion member or travel thereon;
(e) a crossarm connected to said sleeve assembly and extending laterally substantially equidistant on either side of said stanchion;
(f) fork member connected to said cross arm and disposed on opposite sides of said stanchion member;
(g) a non-floating platform mounted on said forks adapted for lifting the hull of a watercraft;
(h) a lifting member connected to said sleeve assembly; and
(i) mechanical multiplying means mounted on said stanchion member and connected to said lifting member for lifting substantially said entire non-floating platform and watercraft above said body of water.

13. A seaplane lift mounted in the soil or a foundation beneath a body of water for lifting a seaplane having twin pontoons comprising:

(a) a single stanchion load bearing member anchored in said soil or foundation;

(b) a base plate connected to the top of said stanchion;

(c) a bracket member connected to said base plate laterally disposed from said stanchion member and adapted for connection to a stabilizing member;

(d) a sleeve assembly slidably mounted on said stanchion member for travel thereon;

(e) a cross arm means connected to said sleeve assembly and extending laterally substantially equidistant on either side of said stanchion;

(f) fork members connected to said cross arm means and disposed on opposite sides of said stanchion member;

(g) platform means mounted on said fork members having pontoon platforms adapted for supporting said twin pontoons of said seaplane;

(h) a lifting member connected to said sleeve assembly;

(i) mechanical multiplying means mounted on said stanchion member and connected to said lifting member for lifting substantially said entire platform means and seaplane above said body of water;

(j) target pontoon bumpers mounted on said platform means forwardly of said pontoon platforms for limiting the forward movement of said pontoons; and (k) pontoon guide means mounted on said platform means on opposite sides of said pontoon platforms for limiting lateral movment of said pontoons.

14. A seaplane lift as described in claim 13 comprising:

(a) said pontoon guide means include a plurality of upright members spaced adjacent said pontoon platforms and buoyant fender means slidably mounted on each of said upright members for upward free sliding movement.

* * * * *

UNITED STATES PATENT AND TRADEMARK OFFICE

CERTIFICATE OF CORRECTION

PATENT NO. : 4,714,375

DATED : December 22, 1987

INVENTOR(S) : Ernest W. Stevenson and Randall E. Nahas

It is certified that error appears in the above-identified patent and that said Letters Patent is hereby corrected as shown below:

Face page under ABSTRACT, line 16 change the word "spaced" to ---space---.
Column 3, line 21, after the words "as a 1/2" insert ---"---.
Column 5, line 3, after the words "chain hoist" change "y" to ---by---.
Column 9, line 65, after the numbers 2"x2"x3/16" insert---"---.
Column 10, line 48, change the word "fonmed" to ---formed---.
Column 12, line 56, change the word "or" to ---for---.

Signed and Sealed this

Twenty-fourth Day of May, 1988

*Attest:*

*Attesting Officer*

DONALD J. QUIGG

*Commissioner of Patents and Trademarks*